US008160287B2

(12) United States Patent
Slippy et al.

(10) Patent No.: US 8,160,287 B2
(45) Date of Patent: Apr. 17, 2012

(54) HEADSET WITH ADJUSTABLE HEADBAND

(75) Inventors: Gordon Slippy, Murrysville, PA (US); Doug Keeports, Murrysville, PA (US)

(73) Assignee: Vocollect, Inc., Pittsburgh, PA (US)

( * ) Notice: Subject to any disclaimer, the term of this patent is extended or adjusted under 35 U.S.C. 154(b) by 363 days.

(21) Appl. No.: 12/470,660

(22) Filed: May 22, 2009

(65) Prior Publication Data

US 2010/0296683 A1 Nov. 25, 2010

(51) Int. Cl.
*H04R 25/00* (2006.01)

(52) U.S. Cl. ..... 381/377; 381/367; 381/374; 381/379

(58) Field of Classification Search ..... 381/367, 381/370, 374–377, 379
See application file for complete search history.

(56) References Cited

U.S. PATENT DOCUMENTS

| | | | | |
|---|---|---|---|---|
| 1,483,315 | A | 2/1924 | Saal | |
| 1,546,567 | A * | 7/1925 | Childress | 381/377 |
| 1,568,721 | A * | 1/1926 | Butcher et al. | 381/379 |
| 1,649,551 | A * | 11/1927 | Smith | 381/378 |
| D130,619 | S | 12/1941 | Kendall | |
| D153,112 | S | 3/1949 | Braun et al. | |
| 2,506,524 | A | 5/1950 | Stuck | |
| 2,782,423 | A | 2/1957 | Wiegand et al. | |
| 2,958,769 | A | 11/1960 | Bounds | |
| 3,087,028 | A | 4/1963 | Ernest | |
| D196,654 | S | 10/1963 | Van Den Berg | |
| 3,192,326 | A | 6/1965 | Chapman | |
| D206,665 | S | 1/1967 | Sanzone | |
| 3,325,824 | A * | 6/1967 | Donegan | 2/8.1 |
| 3,327,807 | A | 6/1967 | Mullin | |
| D212,863 | S | 12/1968 | Roberts | |
| 3,447,160 | A * | 6/1969 | Teder | 2/209 |
| 3,568,271 | A | 3/1971 | Husserl | |
| 3,654,406 | A | 4/1972 | Reinthaler | |
| 3,682,268 | A * | 8/1972 | Gorike | 181/129 |
| 3,969,796 | A | 7/1976 | Hodsdon | |
| 3,971,900 | A | 7/1976 | Foley | |
| 3,971,901 | A | 7/1976 | Foley | |
| 3,984,885 | A | 10/1976 | Yoshimura | |

(Continued)

FOREIGN PATENT DOCUMENTS

CN 201204685 3/2009

(Continued)

OTHER PUBLICATIONS

Lawrence Rabiner and Biing-Hwang Juang, Fundamentals of Speech Recognition, Prentice Hall PTR, United States edition (Apr. 22, 1993), ISBN: 0130151572, pp. 95-117.

(Continued)

*Primary Examiner* — David S. Warren
(74) *Attorney, Agent, or Firm* — Wood, Herron & Evans, LLP

(57) ABSTRACT

A headset includes an element to be held to the head of a wearer and a headband coupled to the element and configured for engaging a head of a wearer to hold the element thereon. The headband includes a plurality of headband arms coupled to pivot with respect to each other. A torsion spring is positioned between the arms and portions of the torsion spring are coupled to the arms for acting on the arms with a torsion force. An adjustment member is coupled between the torsion spring and a headband arm and is operable for adjusting the torsion force of the torsion spring to adjust the torsion force on the arms.

21 Claims, 7 Drawing Sheets

U.S. PATENT DOCUMENTS

| | | | | | |
|---|---|---|---|---|---|
| 4,018,599 | A | | 4/1977 | Hill et al. | |
| 4,020,297 | A | | 4/1977 | Brodie | |
| 4,024,368 | A | | 5/1977 | Shattuck | |
| 4,031,295 | A | | 6/1977 | Rigazio | |
| 4,039,765 | A | | 8/1977 | Tichy | |
| 4,043,001 | A | * | 8/1977 | Parsons | 16/222 |
| 4,073,038 | A | * | 2/1978 | Curry et al. | 16/301 |
| 4,138,598 | A | | 2/1979 | Cech | |
| 4,189,788 | A | | 2/1980 | Schenke | |
| 4,239,936 | A | | 12/1980 | Sakoe | |
| RE30,662 | E | | 6/1981 | Foley | |
| 4,277,654 | A | * | 7/1981 | Penning | 381/309 |
| 4,302,635 | A | | 11/1981 | Jacobsen | |
| D265,989 | S | | 8/1982 | Harris | |
| 4,357,488 | A | | 11/1982 | Knighton et al. | |
| D268,675 | S | | 4/1983 | Hass | |
| 4,409,442 | A | * | 10/1983 | Kamimura | 381/383 |
| 4,418,248 | A | | 11/1983 | Mathis | |
| 4,419,788 | A | * | 12/1983 | Prout | 16/300 |
| 4,471,496 | A | | 9/1984 | Gardner | |
| 4,472,607 | A | | 9/1984 | Houng | |
| 4,499,593 | A | | 2/1985 | Antle | |
| D278,805 | S | | 5/1985 | Bulgari | |
| 4,625,083 | A | | 11/1986 | Poikela | |
| 4,634,816 | A | | 1/1987 | O'Malley et al. | |
| 4,672,672 | A | | 6/1987 | Eggert et al. | |
| 4,672,674 | A | | 6/1987 | Clough | |
| 4,689,822 | A | | 8/1987 | Houng | |
| 4,727,585 | A | * | 2/1988 | Flygstad | 381/379 |
| 4,783,822 | A | * | 11/1988 | Toole et al. | 381/379 |
| D299,129 | S | | 12/1988 | Wiegel | |
| 4,821,318 | A | | 4/1989 | Wu | |
| D301,145 | S | | 5/1989 | Besasie et al. | |
| 4,845,650 | A | | 7/1989 | Meade et al. | |
| 4,875,233 | A | | 10/1989 | Derhaag | |
| 4,907,266 | A | | 3/1990 | Chen | |
| 4,952,024 | A | | 8/1990 | Gale | |
| D313,092 | S | | 12/1990 | Nilsson | |
| 5,003,589 | A | | 3/1991 | Chen | |
| 5,018,599 | A | | 5/1991 | Dohi | |
| 5,023,824 | A | | 6/1991 | Chadima et al. | |
| D318,670 | S | | 7/1991 | Taniguchi | |
| 5,028,083 | A | | 7/1991 | Mischenko | |
| 5,048,155 | A | * | 9/1991 | Hwang | 16/301 |
| 5,056,161 | A | | 10/1991 | Breen | |
| D321,879 | S | | 11/1991 | Emmerling | |
| 5,113,428 | A | | 5/1992 | Fitzgerald | |
| D326,655 | S | | 6/1992 | Iribe | |
| 5,155,659 | A | | 10/1992 | Kunert | |
| 5,177,784 | A | | 1/1993 | Hu | |
| 5,179,736 | A | | 1/1993 | Scanlon | |
| 5,185,807 | A | * | 2/1993 | Bergin et al. | 381/378 |
| D334,043 | S | | 3/1993 | Taniguchi et al. | |
| 5,197,332 | A | | 3/1993 | Shennib | |
| 5,202,197 | A | | 4/1993 | Ansell | |
| D337,116 | S | | 7/1993 | Hattori | |
| 5,225,293 | A | | 7/1993 | Mitchell | |
| 5,251,105 | A | | 10/1993 | Kobayashi | |
| D341,567 | S | | 11/1993 | Acker | |
| 5,267,181 | A | | 11/1993 | George | |
| 5,281,957 | A | | 1/1994 | Schoolman | |
| D344,494 | S | | 2/1994 | Cardenas | |
| D344,522 | S | | 2/1994 | Taniguchi | |
| 5,293,647 | A | * | 3/1994 | Mirmilshteyn et al. | 2/209 |
| 5,305,244 | A | | 4/1994 | Newman et al. | |
| 5,369,857 | A | | 12/1994 | Sacherman | |
| 5,371,679 | A | | 12/1994 | Abe et al. | |
| 5,381,473 | A | | 1/1995 | Andrea | |
| 5,381,486 | A | | 1/1995 | Ludeke | |
| 5,406,037 | A | | 4/1995 | Nageno | |
| 5,438,626 | A | | 8/1995 | Neuman | |
| 5,438,698 | A | | 8/1995 | Burton et al. | |
| 5,446,788 | A | | 8/1995 | Lucey et al. | |
| 5,469,505 | A | | 11/1995 | Gattey | |
| D365,559 | S | | 12/1995 | Fathi | |
| 5,475,791 | A | | 12/1995 | Schalk | |
| 5,479,001 | A | | 12/1995 | Kumar | |
| D367,256 | S | | 2/1996 | Tokunaga | |
| 5,491,651 | A | | 2/1996 | Janik | |
| 5,501,571 | A | | 3/1996 | Van Durrett et al. | |
| 5,515,303 | A | | 5/1996 | Cargin et al. | |
| 5,535,437 | A | | 7/1996 | Karl et al. | |
| 5,553,312 | A | | 9/1996 | Gattey et al. | |
| 5,555,490 | A | | 9/1996 | Carroll | |
| 5,555,554 | A | | 9/1996 | Hofer | |
| 5,563,952 | A | | 10/1996 | Mercer | |
| 5,572,401 | A | | 11/1996 | Carroll | |
| 5,572,623 | A | | 11/1996 | Pastor | |
| 5,579,400 | A | | 11/1996 | Ballein | |
| D376,598 | S | | 12/1996 | Hayashi | |
| D377,020 | S | | 12/1996 | Bungardt et al. | |
| 5,581,492 | A | | 12/1996 | Janik | |
| 5,590,213 | A | * | 12/1996 | Urella et al. | 381/370 |
| 5,604,050 | A | | 2/1997 | Brunette et al. | |
| 5,604,813 | A | | 2/1997 | Evans et al. | |
| 5,606,743 | A | * | 2/1997 | Vogt et al. | 455/347 |
| 5,607,792 | A | | 3/1997 | Garcia et al. | |
| D380,199 | S | | 6/1997 | Beruscha | |
| 5,637,417 | A | | 6/1997 | Engmark | |
| D384,072 | S | | 9/1997 | Ng | |
| 5,665,485 | A | | 9/1997 | Kuwayama et al. | |
| 5,671,037 | A | | 9/1997 | Ogasawara et al. | |
| 5,673,325 | A | | 9/1997 | Andrea | |
| 5,673,364 | A | | 9/1997 | Bialik | |
| D385,272 | S | | 10/1997 | Jensen | |
| 5,680,465 | A | | 10/1997 | Boyden | |
| D385,855 | S | | 11/1997 | Ronzani | |
| D387,898 | S | | 12/1997 | Ronzani | |
| D390,552 | S | | 2/1998 | Ronzani | |
| D391,234 | S | | 2/1998 | Chacon et al. | |
| 5,716,730 | A | | 2/1998 | Deguchi | |
| 5,719,743 | A | | 2/1998 | Jenkins et al. | |
| 5,719,744 | A | | 2/1998 | Jenkins et al. | |
| D394,436 | S | | 5/1998 | Hall et al. | |
| 5,749,072 | A | | 5/1998 | Mazurkiewicz et al. | |
| 5,757,339 | A | | 5/1998 | Williams et al. | |
| 5,762,512 | A | | 6/1998 | Trant et al. | |
| 5,766,794 | A | | 6/1998 | Brunette et al. | |
| 5,774,096 | A | | 6/1998 | Usuki et al. | |
| 5,774,837 | A | | 6/1998 | Yeldener | |
| 5,778,026 | A | | 7/1998 | Zak | |
| 5,778,490 | A | * | 7/1998 | Curtis | 16/198 |
| 5,781,644 | A | | 7/1998 | Chang | |
| 5,787,166 | A | | 7/1998 | Ullman | |
| 5,787,361 | A | | 7/1998 | Chen | |
| 5,787,387 | A | | 7/1998 | Aguilar | |
| 5,787,390 | A | | 7/1998 | Quinquis | |
| 5,793,865 | A | | 8/1998 | Leifer | |
| 5,793,878 | A | | 8/1998 | Chang | |
| D398,899 | S | | 9/1998 | Chaco | |
| D400,848 | S | | 11/1998 | Clark et al. | |
| 5,832,098 | A | | 11/1998 | Chen | |
| 5,841,630 | A | | 11/1998 | Seto | |
| 5,841,859 | A | | 11/1998 | Chen | |
| D402,651 | S | | 12/1998 | Depay et al. | |
| 5,844,824 | A | | 12/1998 | Newman et al. | |
| 5,856,038 | A | | 1/1999 | Mason | |
| 5,857,148 | A | | 1/1999 | Weisshappel et al. | |
| 5,860,204 | A | | 1/1999 | Krengel | |
| 5,862,241 | A | | 1/1999 | Nelson | |
| D406,098 | S | | 2/1999 | Walter et al. | |
| 5,869,204 | A | | 2/1999 | Kottke et al. | |
| 5,873,070 | A | | 2/1999 | Bunte et al. | |
| 5,890,074 | A | | 3/1999 | Rydbeck | |
| 5,890,108 | A | | 3/1999 | Yeldener | |
| 5,895,729 | A | | 4/1999 | Phelps et al. | |
| D409,137 | S | | 5/1999 | Sumita | |
| 5,905,632 | A | | 5/1999 | Seto et al. | |
| D410,466 | S | | 6/1999 | Mouri | |
| D410,921 | S | | 6/1999 | Luchs et al. | |
| D411,179 | S | | 6/1999 | Toyosato | |
| 5,931,513 | A | | 8/1999 | Conti | |
| 5,933,330 | A | | 8/1999 | Beutler et al. | |
| 5,935,729 | A | | 8/1999 | Mareno | |
| D413,582 | S | | 9/1999 | Tompkins | |
| D414,470 | S | | 9/1999 | Chacon | |
| 5,964,268 | A | * | 10/1999 | Carper et al. | 160/191 |

5,991,085 A 11/1999 Rallison et al.
5,999,085 A 12/1999 Szwarc
6,014,619 A 1/2000 Wuppermann et al.
6,016,347 A 1/2000 Magnasco
6,021,207 A 2/2000 Puthuff et al.
D422,962 S 4/2000 Shevlin et al.
6,051,334 A 4/2000 Tsurumaru
D424,035 S 5/2000 Steiner
6,060,193 A 5/2000 Remes
6,061,647 A 5/2000 Barrett
6,071,640 A 6/2000 Robertson et al.
6,075,857 A 6/2000 Doss et al.
6,078,825 A 6/2000 Hahn et al.
6,084,556 A 7/2000 Zwern
6,085,428 A 7/2000 Casby et al.
6,091,546 A 7/2000 Spitzer
D430,158 S 8/2000 Bhatia
D430,159 S 8/2000 Bhatia et al.
6,101,260 A 8/2000 Jensen
6,114,625 A 9/2000 Hughes et al.
6,120,932 A 9/2000 Slipy et al.
D431,562 S 10/2000 Bhatia et al.
6,127,990 A 10/2000 Zwern
6,136,467 A 10/2000 Phelps et al.
6,137,868 A 10/2000 Leach
6,137,879 A 10/2000 Papadopoulos et al.
6,154,669 A 11/2000 Hunter et al.
D434,762 S 12/2000 Ikenaga
6,157,533 A 12/2000 Sallam
6,160,702 A 12/2000 Lee
6,167,413 A 12/2000 Daley
D436,104 S 1/2001 Bhatia
6,171,138 B1 1/2001 Lefebvre et al.
6,179,192 B1 1/2001 Weinger et al.
6,188,985 B1 2/2001 Thrift
6,190,795 B1 2/2001 Daley
D440,966 S 4/2001 Ronzani
6,225,777 B1 5/2001 Garcia et al.
6,226,622 B1 5/2001 Dabbiere
6,229,694 B1 5/2001 Kono
6,230,029 B1 5/2001 Hahn et al.
6,235,420 B1 5/2001 Ng
6,237,051 B1 5/2001 Collins
D443,870 S 6/2001 Carpenter et al.
6,252,970 B1 6/2001 Poon et al.
6,261,715 B1 7/2001 Nakamura et al.
D449,289 S 10/2001 Weikel et al.
6,302,454 B1 10/2001 Tsurumaru
6,304,430 B1 10/2001 Laine
6,304,459 B1 10/2001 Toyosato et al.
6,310,888 B1 10/2001 Hamlin
6,324,053 B1 11/2001 Kamijo
D451,903 S 12/2001 Amae et al.
D451,907 S 12/2001 Amae et al.
6,325,507 B1 12/2001 Jannard
6,326,543 B1 12/2001 Lamp
6,327,152 B1 12/2001 Saye
6,339,706 B1 1/2002 Tillgren
6,339,764 B1 1/2002 Livesay et al.
6,349,001 B1 2/2002 Spitzer
6,353,313 B1 3/2002 Estep
6,356,635 B1 3/2002 Lyman et al.
6,357,534 B1 3/2002 Buetow et al.
6,359,603 B1 3/2002 Zwern
6,359,777 B1 3/2002 Newman
6,359,995 B1 3/2002 Ou
6,364,126 B1 4/2002 Enriquez
6,369,952 B1 4/2002 Rallison et al.
6,371,535 B2 4/2002 Wei
6,373,693 B1 4/2002 Seto et al.
6,373,942 B1 4/2002 Braund
6,374,126 B1 4/2002 MacDonald, Jr. et al.
6,376,942 B1 4/2002 Burger
6,377,825 B1 4/2002 Kennedy et al.
D457,133 S 5/2002 Yoneyama
6,384,591 B1 5/2002 Estep
6,384,982 B1 5/2002 Spitzer
6,386,107 B1 5/2002 Rancourt
6,394,278 B1 5/2002 Reed
6,434,251 B1 8/2002 Jensen
6,445,175 B1 9/2002 Estep
6,446,042 B1 9/2002 Detlef
6,453,020 B1 9/2002 Hughes et al.
D463,784 S 10/2002 Taylor et al.
6,460,220 B1 * 10/2002 Jackson ..... 16/285
6,466,681 B1 10/2002 Siska, Jr.
D465,208 S 11/2002 Lee et al.
D465,209 S 11/2002 Rath
D466,497 S 12/2002 Wikel
6,496,111 B1 12/2002 Hosack
6,500,581 B2 12/2002 White et al.
D469,080 S 1/2003 Kohli
6,511,770 B2 1/2003 Chang
6,532,148 B2 3/2003 Jenks
6,560,092 B2 5/2003 Itou et al.
6,562,950 B2 5/2003 Peretz et al.
6,581,782 B2 6/2003 Reed
6,595,316 B2 * 7/2003 Cybulski et al. ..... 181/131
6,600,798 B2 7/2003 Wuppermann
6,615,174 B1 9/2003 Arslan
6,628,509 B2 9/2003 Kono
6,633,839 B2 10/2003 Kushner et al.
D482,019 S 11/2003 Petersen et al.
6,654,966 B2 * 12/2003 Rolla ..... 2/209
6,658,130 B2 12/2003 Huang
6,660,427 B1 12/2003 Hukill
D487,064 S 2/2004 Stekelenburg
6,697,465 B1 2/2004 Goss
6,711,273 B2 * 3/2004 Bebenroth ..... 381/379
D488,146 S 4/2004 Minto
D488,461 S 4/2004 Okada
6,728,325 B1 4/2004 Hwang
6,731,771 B2 5/2004 Cottrell
6,732,408 B2 * 5/2004 Wu ..... 16/298
D491,917 S 6/2004 Asai
D492,295 S 6/2004 Glatt
6,743,535 B2 6/2004 Yoneyama
6,745,014 B1 6/2004 Seibert
6,749,960 B2 6/2004 Takeshita
6,754,361 B1 * 6/2004 Hall et al. ..... 381/370
6,754,632 B1 6/2004 Kalinowski et al.
6,757,651 B2 6/2004 Vergin
D494,517 S 8/2004 Platto et al.
6,769,762 B2 8/2004 Saito et al.
6,769,767 B2 8/2004 Swab et al.
6,772,114 B1 8/2004 Sluijter et al.
6,778,676 B2 8/2004 Groth
6,795,805 B1 9/2004 Bessette et al.
D498,231 S 11/2004 Jacobson et al.
6,811,088 B2 11/2004 Lanzaro et al.
6,826,532 B1 11/2004 Casby et al.
6,847,336 B1 1/2005 Lemelson
6,885,735 B2 4/2005 Odinak et al.
D506,065 S 6/2005 Sugino et al.
6,909,546 B2 6/2005 Hirai
D507,523 S 7/2005 Resch et al.
6,934,675 B2 8/2005 Glinski
6,965,681 B2 11/2005 Almqvist
D512,417 S 12/2005 Hirakawa et al.
D512,984 S 12/2005 Ham
D512,985 S 12/2005 Travers et al.
7,013,018 B2 3/2006 Bogeskov-Jensen
D519,497 S 4/2006 Komiyama
7,027,774 B2 4/2006 Kuon
D521,492 S 5/2006 Ham
7,046,649 B2 5/2006 Awater et al.
7,050,598 B1 5/2006 Ham
7,052,799 B2 5/2006 Zatezalo et al.
7,063,263 B2 6/2006 Swartz et al.
D524,794 S 7/2006 Kim
D525,237 S 7/2006 Viduya
7,076,236 B2 7/2006 Ihira et al.
7,082,393 B2 7/2006 Lahr
7,085,543 B2 8/2006 Nassimi
7,099,464 B2 8/2006 Lucey et al.
7,106,877 B1 9/2006 Linville
7,107,057 B2 9/2006 Arazi et al.
7,110,800 B2 9/2006 Nagayasu et al.

| | | | | |
|---|---|---|---|---|
| 7,110,801 | B2 | 9/2006 | Nassimi | |
| D529,447 | S | 10/2006 | Greenfield | |
| D531,586 | S | 11/2006 | Poulet | |
| 7,136,684 | B2 | 11/2006 | Matsuura et al. | |
| 7,143,041 | B2 | 11/2006 | Sacks et al. | |
| D537,438 | S | 2/2007 | Hermansen | |
| 7,181,402 | B2 | 2/2007 | Jax | |
| 7,203,651 | B2 | 4/2007 | Baruch et al. | |
| 7,210,199 | B2 * | 5/2007 | Clark | 16/299 |
| 7,225,130 | B2 | 5/2007 | Roth et al. | |
| 7,242,765 | B2 | 7/2007 | Hairston | |
| D549,216 | S | 8/2007 | Viduya | |
| D549,217 | S | 8/2007 | Viduya | |
| D549,694 | S | 8/2007 | Viduya et al. | |
| D551,615 | S | 9/2007 | Wahl | |
| D552,595 | S | 10/2007 | Viduya et al. | |
| 7,343,283 | B2 | 3/2008 | Ashley | |
| 7,346,175 | B2 | 3/2008 | Hui et al. | |
| D567,218 | S | 4/2008 | Viduya et al. | |
| D567,219 | S | 4/2008 | Viduya et al. | |
| D567,799 | S | 4/2008 | Viduya et al. | |
| D567,806 | S | 4/2008 | Viduya et al. | |
| 7,356,156 | B2 * | 4/2008 | R egg | 381/379 |
| 7,369,991 | B2 | 5/2008 | Manabe et al. | |
| 7,391,863 | B2 | 6/2008 | Viduya | |
| 7,496,387 | B2 | 2/2009 | Byford et al. | |
| 7,519,186 | B2 | 4/2009 | Varma | |
| 7,519,196 | B2 | 4/2009 | Bech | |
| 2001/0017925 | A1 | 8/2001 | Ceravolo | |
| 2001/0017926 | A1 | 8/2001 | Vicamini | |
| 2001/0036291 | A1 | 11/2001 | Pallai | |
| 2001/0046305 | A1 | 11/2001 | Muranami | |
| 2002/0003889 | A1 | 1/2002 | Fischer | |
| 2002/0015008 | A1 | 2/2002 | Kishida | |
| 2002/0016161 | A1 | 2/2002 | Dellien | |
| 2002/0025057 | A1 * | 2/2002 | Bebenroth | 381/379 |
| 2002/0067825 | A1 | 6/2002 | Baranowski | |
| 2002/0068610 | A1 | 6/2002 | Anvekar | |
| 2002/0076060 | A1 | 6/2002 | Hall | |
| 2002/0091526 | A1 | 7/2002 | Kiessling | |
| 2002/0110246 | A1 | 8/2002 | Gosior | |
| 2002/0111197 | A1 | 8/2002 | Fitzgerald | |
| 2002/0131616 | A1 | 9/2002 | Bronnikov | |
| 2002/0152065 | A1 | 10/2002 | Kopp | |
| 2002/0159574 | A1 | 10/2002 | Stogel | |
| 2003/0095525 | A1 | 5/2003 | Lavin | |
| 2003/0103413 | A1 | 6/2003 | Jacobi, Jr. | |
| 2003/0130852 | A1 | 7/2003 | Tanaka | |
| 2003/0179888 | A1 | 9/2003 | Burnett | |
| 2003/0182243 | A1 | 9/2003 | Gerson | |
| 2003/0212480 | A1 | 11/2003 | Lutter | |
| 2003/0217367 | A1 | 11/2003 | Romano | |
| 2003/0228023 | A1 | 12/2003 | Burnett | |
| 2004/0010407 | A1 | 1/2004 | Kovesi | |
| 2004/0024586 | A1 | 2/2004 | Andersen | |
| 2004/0046637 | A1 | 3/2004 | Van Swaay | |
| 2004/0063475 | A1 | 4/2004 | Weng | |
| 2004/0091129 | A1 | 5/2004 | Jensen | |
| 2005/0141729 | A1 * | 6/2005 | Kanzaki et al. | 381/67 |
| 2005/0149414 | A1 | 7/2005 | Schrodt | |
| 2005/0232436 | A1 | 10/2005 | Nagayasu | |
| 2005/0272401 | A1 | 12/2005 | Zatezalo | |
| 2006/0130276 | A1 * | 6/2006 | Clark | 16/299 |
| 2007/0223766 | A1 | 9/2007 | Davis | |
| 2008/0175406 | A1 * | 7/2008 | Smith | 381/87 |
| 2008/0314533 | A1 * | 12/2008 | Park | 160/313 |
| 2009/0323978 | A1 * | 12/2009 | Leske et al. | 381/72 |
| 2009/0323979 | A1 * | 12/2009 | Leske et al. | 381/72 |
| 2010/0189303 | A1 * | 7/2010 | Danielson et al. | 381/378 |
| 2010/0296683 | A1 * | 11/2010 | Slippy et al. | 381/377 |
| 2011/0116674 | A1 * | 5/2011 | Asakura et al. | 381/378 |
| 2011/0129111 | A1 * | 6/2011 | Santiago | 381/379 |

FOREIGN PATENT DOCUMENTS

| | | |
|---|---|---|
| DE | 2628259 | 12/1977 |
| DE | 3604292 | 8/1987 |
| DE | 102008031017 | 12/2009 |
| EP | 0380290 | 8/1990 |
| EP | 1018854 | 7/2000 |
| EP | 1185135 | 3/2002 |
| GB | 2275846 | 7/1994 |
| JP | 54100612 | 7/1979 |
| JP | 55051594 | 4/1980 |
| JP | 57028570 | 2/1982 |
| JP | 11055776 | 2/1999 |
| WO | WO9737480 | 10/1997 |
| WO | WO2008089444 | 7/2008 |

OTHER PUBLICATIONS

Four-page Vocollect Speech Recognition Headsets brochure-Clarity and comfort. Reliable performance. Copyright Sep. 2005.

Four-page Vocollect Speech Recognition Headsets brochure—SR 30 Series Talkman High-Noise Headset. Copyright 2005.

Two-page Vocollect SR 20 Talkman Lightweight Headset Product Information Sheet. Copyright Aug. 2004.

Photographs 1-7 SR Talkman Headset Aug. 2004—Prior art.

Two-page Supplemental Vocollect SR 20, Talkman Lightweight Headset brochure. Copyright Aug. 2004.

Photographs 1-8 SR Talkman Headset.

Hong Kook Kim, et al.; A Bitstream-Based Front-End for Wireless Speech Recognition on IS-136 Communications Systems; IEEE Transactions on Speech and Audio Processing; Manuscript received Feb. 16, 200, revised Jan. 25, 2001; 11 Pages; vol. 9; No. 5; Jul. 2001; New York, NY, US.

Mladen Russo, et al.; Speech Recognition over Bluetooth ACL and SCO Links; A Comparison; Consumer Communications and Networking Conference 2005; Jan. 3-6, 2005; 5 pages, Las Vegas, NV, US.

English Language Translation of Foreign Reference #1 above (DE2628259).

Twelve-Page International Search Report and Written Opinion dated Aug. 13, 2010 for International Application No. PCT/US2010/035236.

* cited by examiner

HEADSET WITH ADJUSTABLE HEADBAND

FIELD OF THE INVENTION

The invention relates to a headset, and particularly to a headset that is worn for long periods of time.

BACKGROUND OF THE INVENTION

A headset is a common electronic tool used for a variety of different communications tasks. The headset will usually contain one or more earphones or speakers for playing audio to a wearer, and may also include a microphone boom for capturing speech from a wearer. Headsets use a headband to contact a user's head in some fashion, and secure the headset and its components to the user's head.

One type of headband associated with headsets uses a pivoting headband for adjustability. The goal of a headset design, for practical purposes, is to ensure proper fit for a large number of users. A headset with a pivoting headband generally includes two arms that are joined at a pivot point. One or both of the headband arms may be rigid. Often the pivot point is the site of a torsion spring, with one leg of the spring seated in each of the two headband arms. The torsion spring provides a compression force biasing the two arms of the headband into a particular initial position. A user exerts a force to spread or open the headband beyond its initial position and put it on their heads. The compression force provided by the torsion spring helps to keep the headband securely on the user's head.

As conventionally used, the torsion spring within the headband is loaded to a fixed level of torsion, exerting a set biasing torque to the headband arms according to the headband's position. Regardless of the user's head size and the preferred position of the headband, the compression force is set by the spring and the initial position of the headband arms. The load on the torsion spring and the arm positions may not be at a level that is comfortable for all users. Additionally, over time, the load on the torsion spring may decrease as a function of age and wear on the headband, impacting the quality of the fit.

Certain occupational activities, such as customer service, aviation, and voice-directed or voice-assisted work, often require the use of headsets for an extended period of time. Because these headsets may be worn continually for several hours at a time, a comfortable fit is very important. Also, in many work environments, headsets may be shared, and a user may not have the same headset each time he or she works. It is thus desirable to ensure a proper comfortable fit in a headset for various different users.

SUMMARY OF THE INVENTION

A headset includes a headband with a plurality of arms coupled with a torsion spring, and an adjustment member capable of increasing or decreasing the torsion force of the spring in order to change the torque the spring exerts on the headband arms. In one embodiment, the adjustment member may be a bolt engaging a headband arm and the torsion spring. The adjuster bolt is operable to adjust the torsion spring by disengaging or unlocking it and rotating the bolt. In another embodiment, the adjuster may be a worm gear and worm arrangement, wherein the user adjusts the torsion spring by rotating the worm.

BRIEF DESCRIPTION OF THE DRAWINGS

The accompanying drawings, which are incorporated in and constitute a part of this specification, illustrate embodiments of the invention and, together with the detailed description of the embodiments given below, serve to explain the principles of the invention.

DETAILED DESCRIPTION

Figure 1:
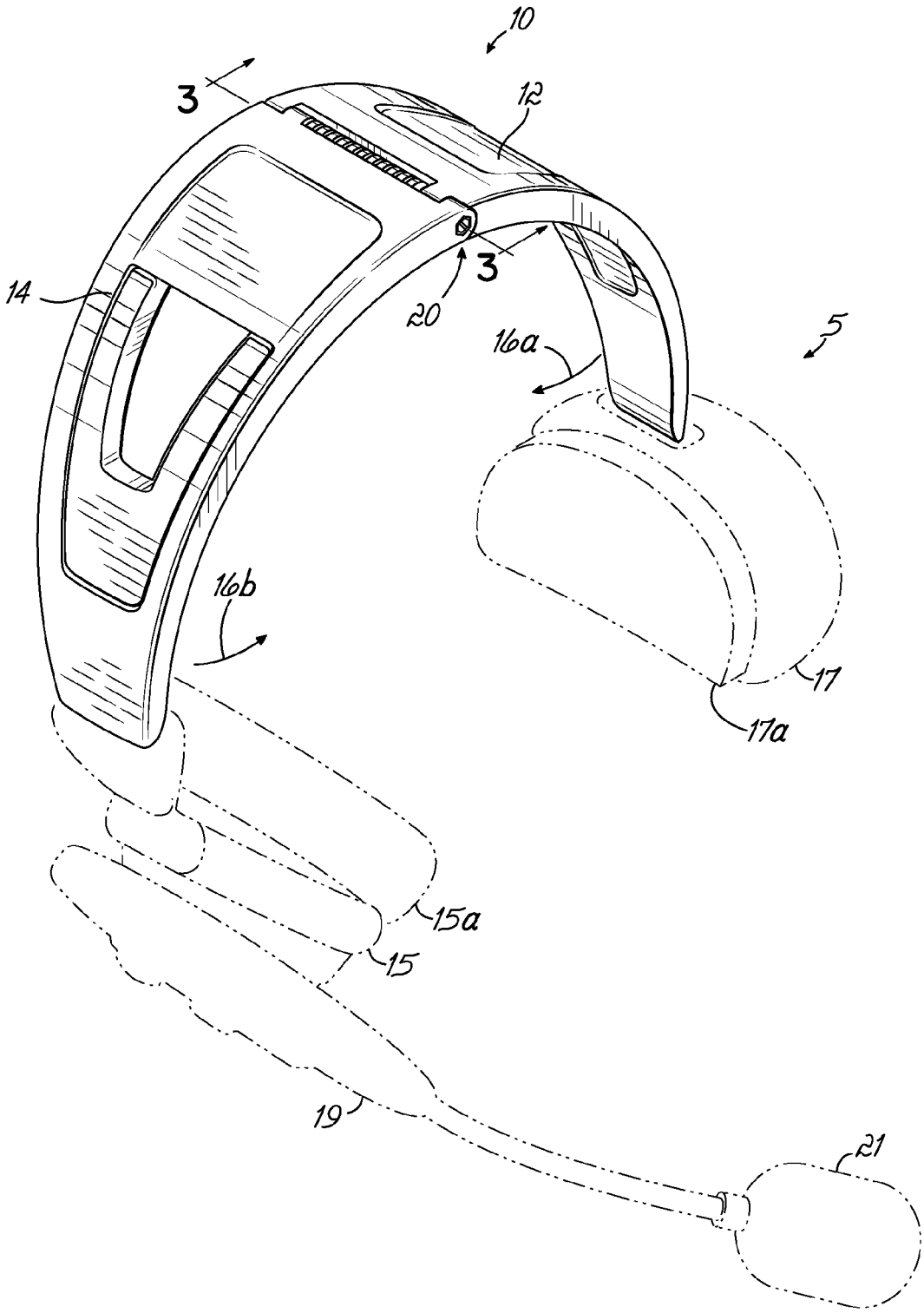
FIG. 1 is a perspective view of a headset headband according to one embodiment of the present invention.
Figure 1A:
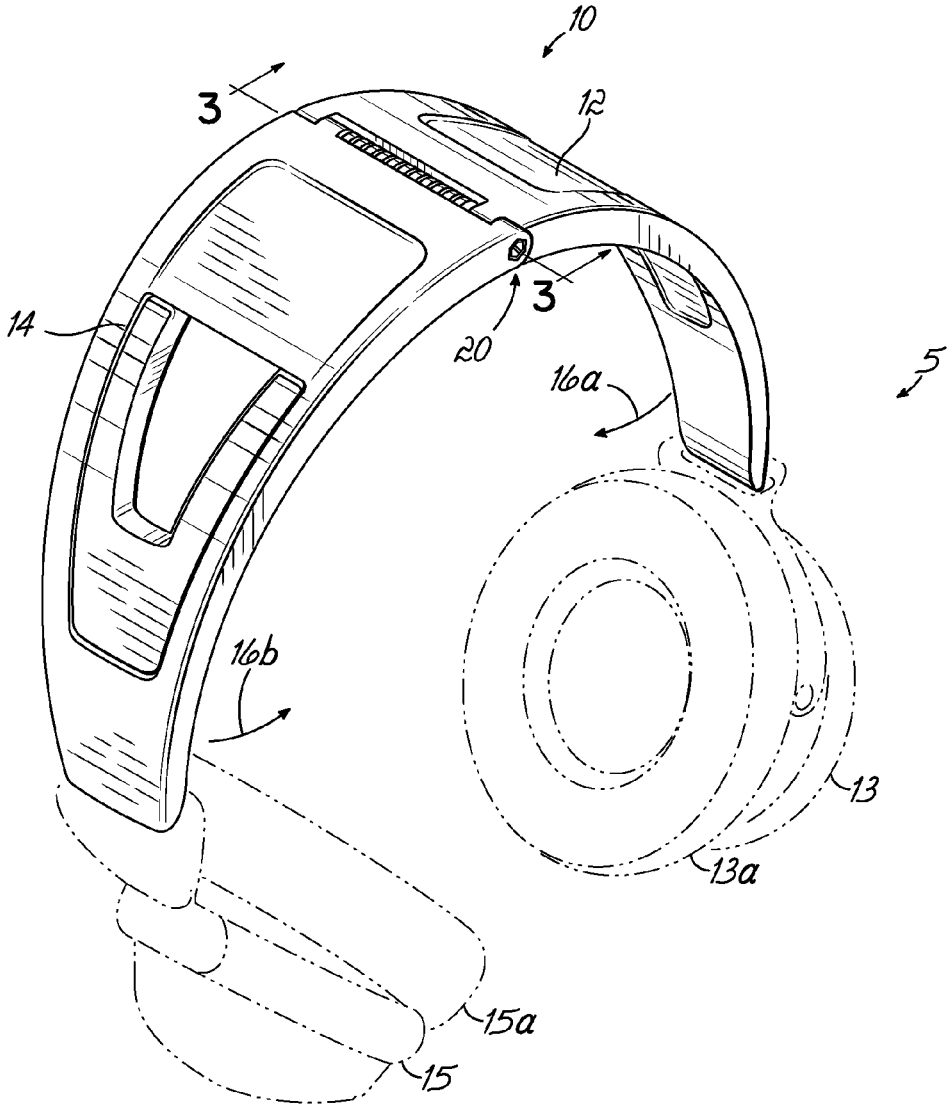
FIG. 1A is another embodiment of the present invention.
Figure 1B:
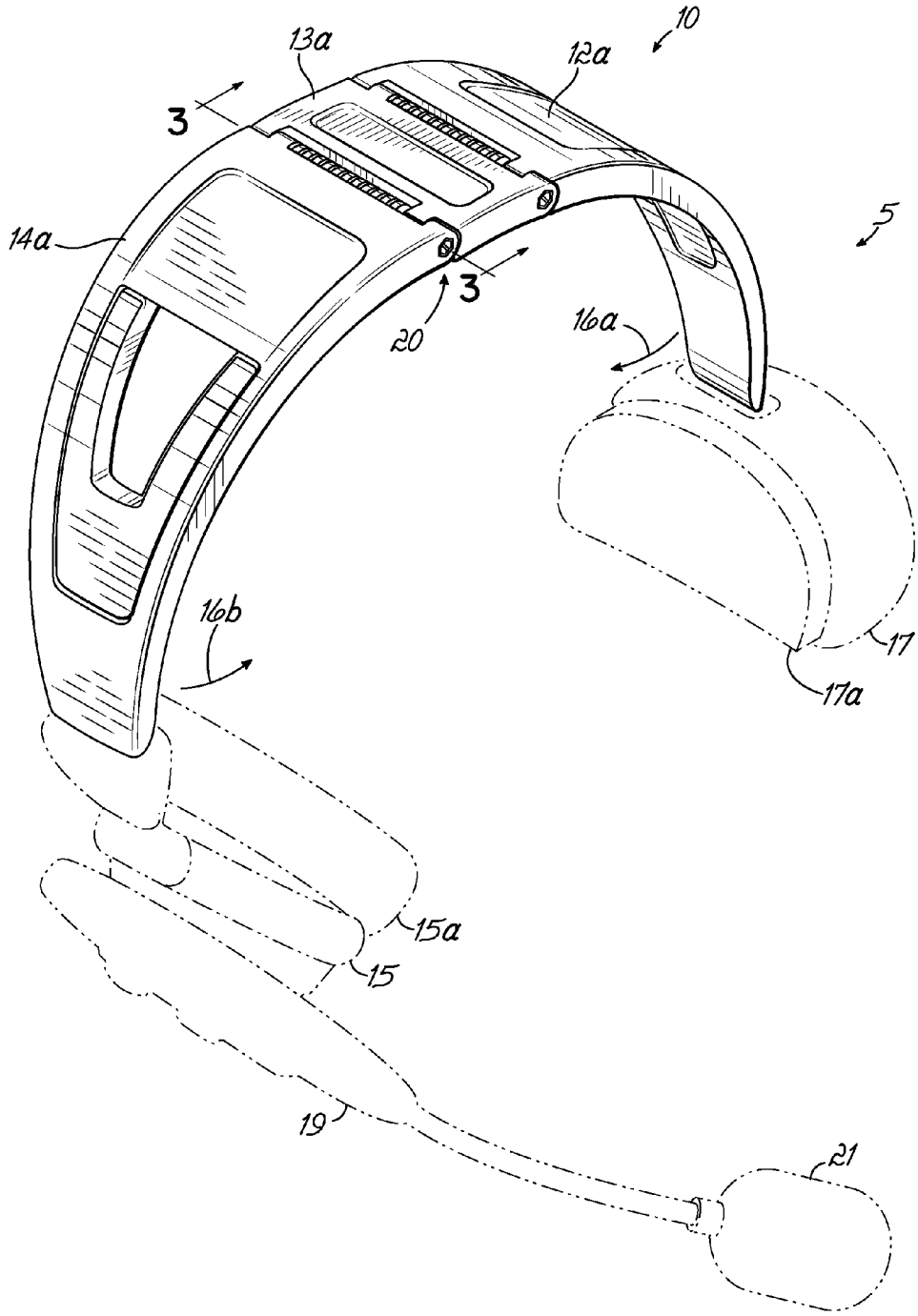
FIG. 1B is another embodiment of the present invention.

FIG. 1 shows an exemplary headband 10 for a headset 5. The headband 10 of FIG. 1 contains two arms 12 and 14 which are connected at a pivot joint 20. While the embodiment illustrated in FIG. 1 shows a headband with two arms, it would be readily understood by a person of ordinary skill in the art that the present invention might be utilized with a headband having any suitable number of appropriate pivoting sections. For example, FIG. 1B illustrates a headset with a headband 10*a* having three pivoting sections 12*a*, 13*a*, and 14*a* for providing greater adjustability to the headset for the comfort of a user or wearer.

Each of the arms 12, 14 may be made of a suitable material, such as plastic, metal, or some other lightweight material. The headband 10 is configured to fit comfortably over the top of the user's head. Of course, the invention might also be used on a headset design where the headband 10 extends around some other section of the user's head, such as the rear of the head, rather than directly over the top, as is shown in the illustrated embodiments. The pivot joint 20 exerts torque on the arms 12, 14 which biases them to rotate downward and toward each other in the directions shown by arrows 16*a* and 16*b*, biasing the headband 10 closer to a wearer's head to grip their head.

Headset 5 will generally hold or secure one or more elements to the head of a wearer. Accordingly, the arms are coupled at ends thereof to such elements. For example, the embodiment of FIG. 1 includes an earphone or speaker 15 for providing sound to the headset to be heard by a wearer. Opposite the speaker 15 are electronics 17 for operating the headset, such as for voice-directed or voice-assisted applications. Although a single speaker 15 is shown in FIG. 1, the headset might also utilize multiple speakers. For example, FIG. 1A illustrates a headset with two speakers 13, 15. For various applications, such as voice-directed or voice-assisted work, the voice of the wearer may also need to be captured. To that end, the headset might include an appropriate microphone boom 19 that includes a microphone 21 to capture the wearer's speech or other utterances, as shown in FIGS. 1 and 1B. Generally, for comfort, the speakers or elements 13, 15, 17 might include appropriate cushions 13*a*, 15*a*, 17*a* for the comfort of a wearer.

Figure 2:
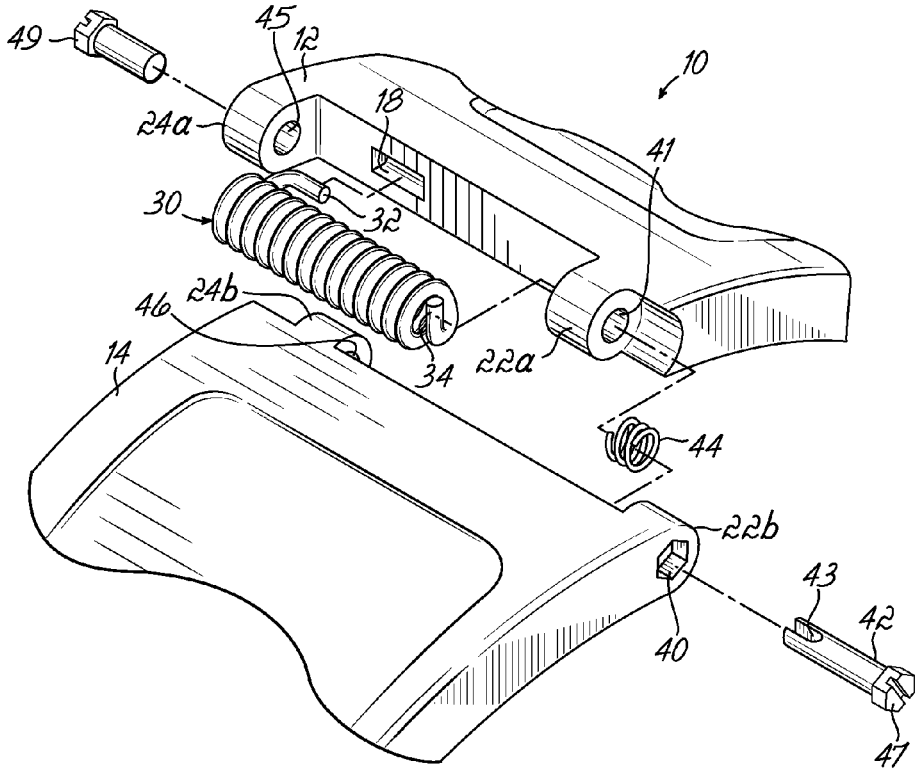
FIG. 2 is a partial exploded view of the pivot joint of the headband of FIG. 1.

FIG. 2 shows a headband adjustment member or adjuster in accordance with one embodiment of the invention. A torsion spring 30 is the source of the torque exerted by the pivot joint 20 on the arms 12, 14. The torsion spring 30, which is illustrated in the form of a helical spring, has two legs 32 and 34 disposed at either end. One end of the helical spring, such as leg 32, engages arm 12 while the other end, such as leg 34, engages arm 14, as discussed further below. For example, the leg 32 engages and seats in a recess 18 located at the pivoting end of the arm 12, as shown in FIG. 2. In that way, the spring exerts a force on arm 12.

The adjustment member of the present invention includes a locked and unlocked position. The adjustment member is configured for being movable, in the unlocked position, to adjust the torsion force of the torsion spring. Conversely, in the locked position, the adjustment member is prevented from being moved, and thus maintains the desired torsion. In the illustrated embodiment of the invention, the torsion spring may be wound to adjust the head-gripping force provided by the headset.

In the embodiments illustrated, two bushings 22*a*, 24*a* extend from the arm 12 and two bushings 22*b*, 24*b* extend from the arm 14. The bushing pairs 24*a*, 24*b* and 22*a*, 22*b* cooperate to provide the pivoting at pivot point 20. The bushing pairs contact or abut against the ends of spring 30. The adjuster element includes an adjuster bolt 42 that extends through openings 40, 41, of the front bushings 22*a* and 22*b*. The leg 34 of the torsion spring 30 is coupled to the adjuster bolt 42. A pin 49 or other conventional hinge member may extend through openings 45, 46 in the bushings 24*a*, 24*b* in order to properly define the pivot joint 20. As discussed below, the adjuster bolt 42 and its cooperation with shaped opening 40 provides an operable coupling of the spring end leg 34 with arm 14 for translation of the spring force to the leg 14.

As shown in FIGS. 3 and 4A-4C, a bias spring member 44 is positioned around the adjuster bolt 42, and seats within the front bushing 22*b*. The bias spring 44 is disposed inside bushing 22*b* and is contained between the bushing 22*a* and the head of the adjuster bolt 42, biasing the adjuster bolt 42 toward the front of the bushing 22*b* and the end of the pivot joint 20. The opening 40 in bushing 22*b* is shaped to correspond with the shape of the shaped head 47 of bolt 42 so that the shaped head 47 seats in the shaped opening 40. In that way, bolt 42 and bushing 22*b* are keyed together to couple them together mechanically so that torque forces from spring 30 are translated to arm 14. The shape also dictates the adjustable positions of the headset. That is, the adjustment will generally be in discrete steps based on the shape of the head 47 and opening 40. For a hexagonal shape of head 47, for example, the adjustment increments are essentially ⅙ of the full rotation of the bolt 42. The discrete steps are a result of the head 47 again having to seat in the opening 40. The head 47 of the adjuster bolt 42 in the illustrated embodiment is hex-shaped, which fits the hex shape of opening 40 at the front face of the bushing 24*b*. When the head 47 of adjuster bolt 42 fits into opening 40, the adjuster bolt 42 is biased by spring 30 to rotate along with the bushing 22*b* and the arm 14. The torsion spring 30 exerts torque on the adjuster bolt 42 through its leg 34 that extends through a slot 43 at the other end of the adjuster bolt 42. While the illustrated embodiment shows bolt 42 with a slot 43 that receives leg 34, the bolt 42 and spring 30 might be otherwise configured so that the end of the bolt 42 mechanically engages the end of the spring. The torque on bolt 42 and head 47 is then exerted against the bushing 22*b* and hence the arm 14. The arm 14 is therefore biased relative to the arm 12 through the action of the torsion spring 30 on the adjuster bolt 42. By adjusting the bolt 42, the squeezing force provided by the arms of headset 10 may be adjusted.

Figure 3:
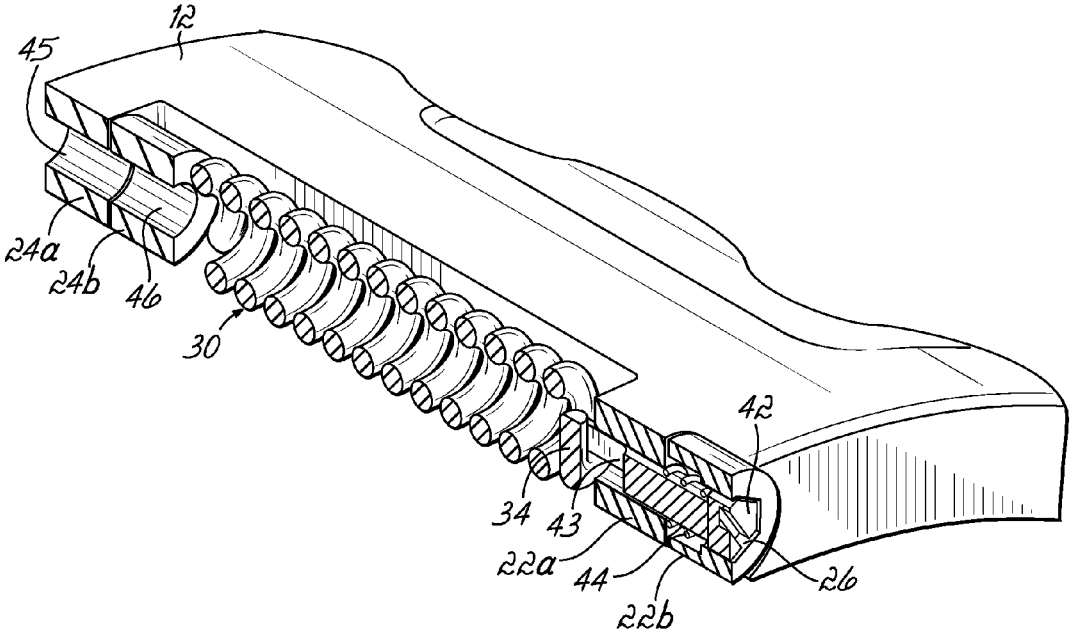
FIG. 3 is a partial cross-section view of the pivot joint of the headband of FIG. 1 taken along line 3-3.
Figure 4A:
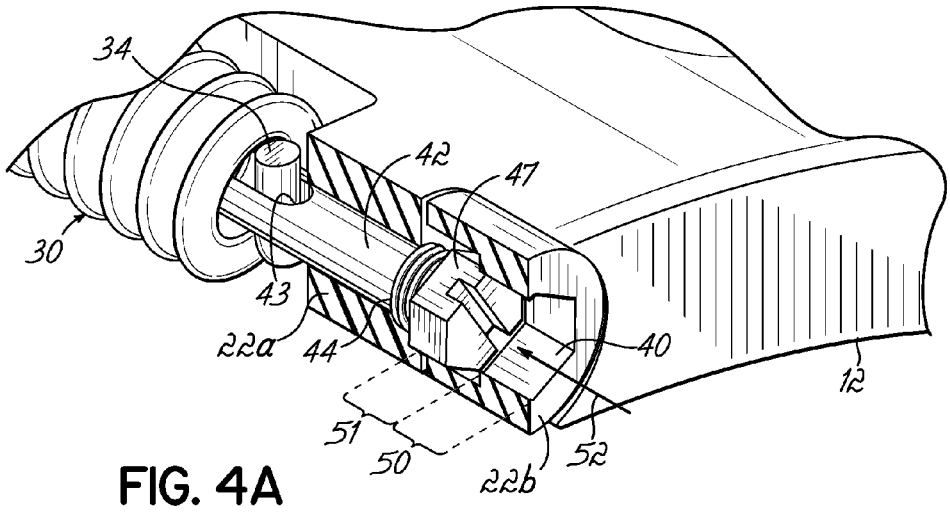
FIGS. 4A through 4C are cut-away views of the pivot joint of the headband of FIG. 1 showing operation of the adjuster bolt.
Figure 4B:
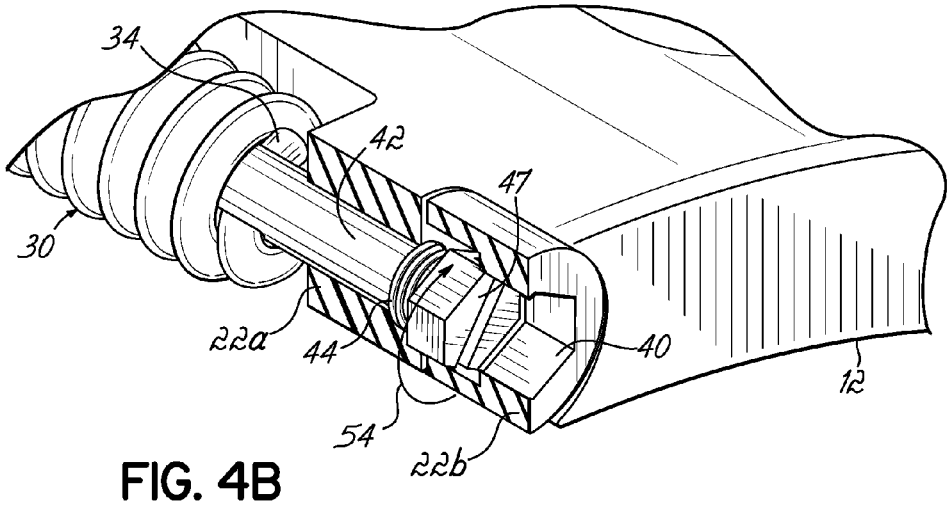
Figure 4C:
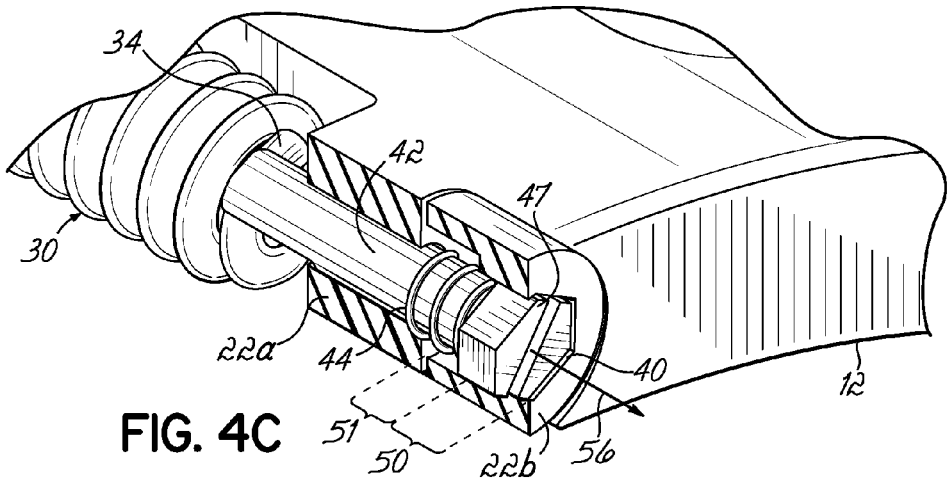

FIGS. 4A through 4C illustrate the process of adjusting the torsion in the torsion spring 30 in order to vary the strength of compression of the headband 10 from the relative torque of the headband arms 12, 14. To turn the bolt 42, the bolt is moved or translated along the pivot axis to the rear part of the bushing 22*b*. The rear part includes an opening dimension that does not restrict rotation of the head of the adjuster bolt 42, and therefore, the head 47 is unseated from shaped opening 40. For example, the opening 40 has a forward portion 50 (see FIG. 4A) that has the shape (e.g., hex shape) corresponding to the shape of head 47 of bolt 42. As illustrated in FIGS. 3 and 4C, when the bolt is biased toward forward portion 50 and shaped opening 40 by the action of spring 44, the head 47 seats in the bushing portion 50 that corresponds with opening 40. As may be appreciated, the shapes of head 47 and the opening 40 in portion 50 are configured to be appropriately keyed together so that, when seated, bolt 42 will not turn without bushing 22*b* and arm 14 rotating as well. Hence, the spring 30 translates its force to arm 14, as noted to rotate arm 14 relative arm 12.

However, opening 40 also has a larger rear portion 51 behind shaped forward portion 50. The larger portion 51 of the busing is shaped and sized appropriately such that the head 47 freely rotates when it is positioned in alignment with portion 51. FIGS. 4A and 4B illustrate the translation and rotation of bolt 42 to adjust the torsion of spring 30.

Turning to FIG. 4A, by translating or pressing the adjuster bolt 42 into pivot joint 20 in the axis direction shown by arrow 52 (compressing the bias spring 44 in the process), the head of the bolt 42 is unseated or otherwise disengaged from portion 50 of the bushing 22*b*, and is free to rotate. A screwdriver or other suitable tool can be used to rotate the adjuster bolt 42 as shown by arrow 54 in FIG. 4B. The disengaged or unseated bolt 42 is translated so that head 47 sits in the larger portion 51 of opening 40, and is free to rotate. Although the adjuster bolt 42 as shown in FIGS. 1-4C accepts a flathead screwdriver, as an alternative, the head of the adjuster bolt may accept a hex key, crosshead, or other screwdriver as known in the art. Rotation of bolt 42 rotates the slotted section 43, and causes a corresponding rotation of the leg 34. This action winds the spring. Depending on the direction of the rotation, this increases or decreases the torsion of the torsion spring 30. Once the desired rotation is reached, the adjuster bolt 42, in its new discrete rotational position, is then allowed to return to its biased position (direction arrow 56, via the force of the bias or bias spring 44) where the head of the bolt 42 in again seated within the frame 26. As noted above, the new position will be some discrete step amount from the original position based on the shaped head 47 and opening 40. The increased or decreased torsion in the torsion spring 30 then translates into a greater or lesser torque force exerted upon the arms 12, 14 for any given relative rotational position of the arms 12, 14. The adjustment member, which includes bolt 42, therefore allows for the torsion in the torsion spring 30 to be adjusted as desired by the user.

Accordingly, the headset of the invention provides a readily adjustable configuration that allows the comfort and wearability of the headset to be adjusted as needed. For example, as the spring 30 loses some of its spring force due to use and age, it may be adjusted. For different users, the headset of the invention may be readily adjusted quickly to provide an increased or decreased force on the head of the wearer for both comfort and for properly securing the headset. The adjustment is easy to facilitate by a user, and thus, improves the wearability of the headset.

Figure 5:
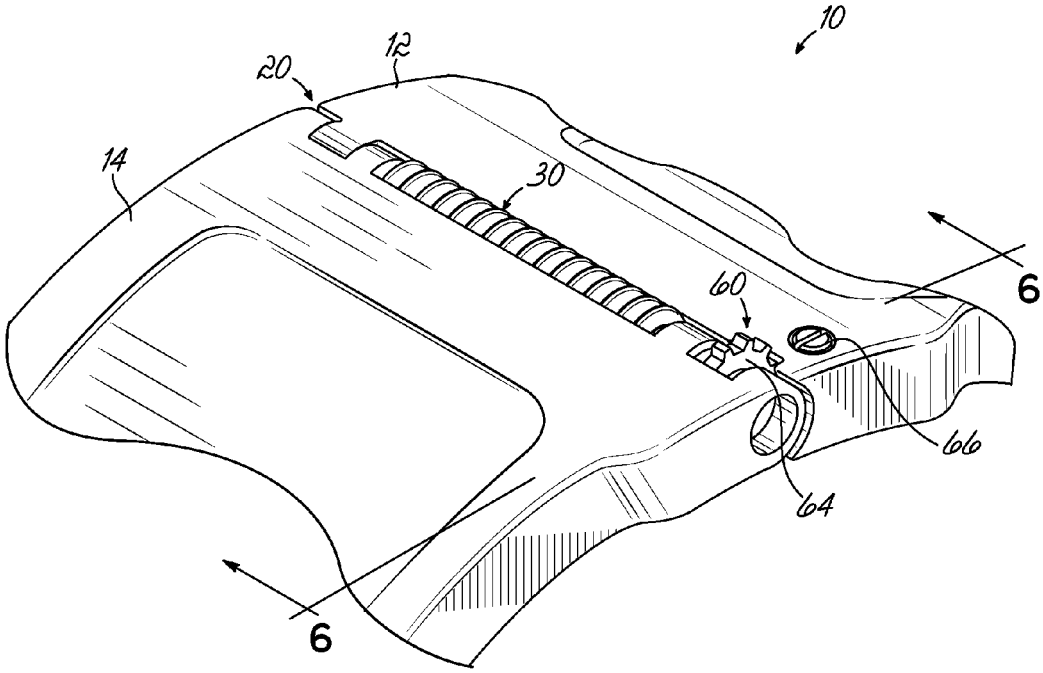
FIG. 5 is a perspective view of the pivot joint of a headset headband according to another embodiment of the invention.
Figure 6:
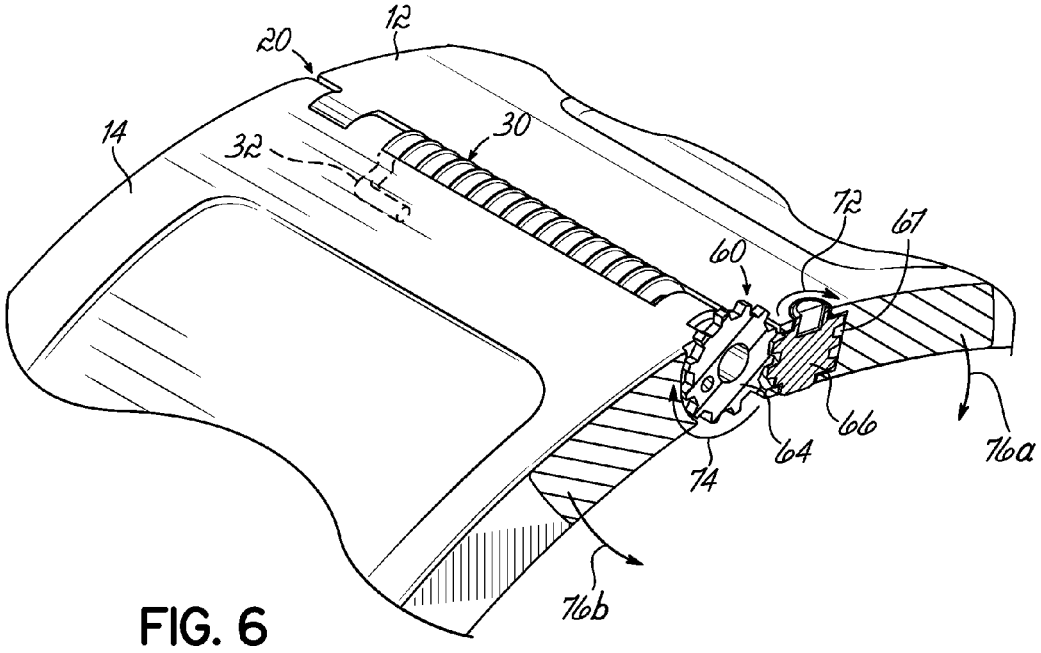
FIG. 6 is a perspective cross section view of the pivot joint of FIG. 5 taken along line 6-6 showing operation of the worm-and-gear adjuster.
Figure 7:
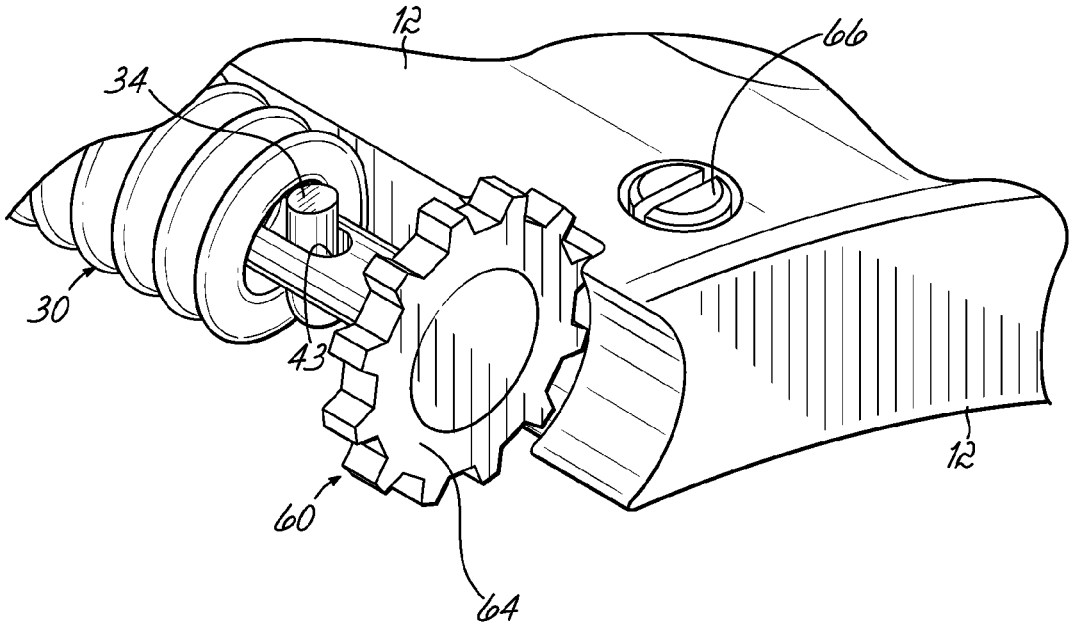
FIG. 7 is a cut-away view of the pivot joint of FIG. 6.

An alternate embodiment of the headset is shown in FIGS. 5-7, where like numbers denote like components. In that embodiment, adjustment of the headset is continuous rather than discrete as in the embodiment of FIGS. 4A-4C. That is, the adjustment may be made at an infinite number of positions between the end limits because the adjustment is continuous rather than discrete as determined by the head 47. In FIG. 5, the leg 32 of the torsion spring 30 is directly coupled to the arm 14 in a suitably mechanical fashion. To adjust the torsion in the spring 30, the adjustment member includes a worm gear arrangement 60. The worm gear arrangement 60 includes worm gear 64 that is coupled mechanically to an end of the torsion spring 30, such as by a slotted shaft (FIG. 7). The end of the slotted shaft might be similar to the end of slotted bolt 42 (See FIG. 2). The gear 64 is also coupled to a worm 66. The worm 66 is secured in an appropriate cavity 67 in an arm, and is secured to rotate in the cavity. In that way, the worm 66 is mechanically coupled with arm 12. Any force on worm 66 is translated to arm 12. The worm gear 64 acts on the spring by rotating the worm 66 as shown by arrow 72, such as with a screwdriver or other suitable tool. A corresponding rotation then occurs in the worm gear 64 as shown by arrow 74. This causes rotation of the portion of the gear engaging spring 30. This then adjusts the torsion of the torsion spring 30 relative to the position of the arms 12, 14, which are biased to close in the direction as shown by arrows 76*a* and 76*b*. FIG. 7 shows a cut-away view of the engagement of worm gear 64 with spring 30. The number of positions of adjustment based on the continuous rotation of the worm and worm gear is theoretically infinite and bound only by the mechanical end points of rotation for the worm and gear.

Therefore, in the embodiment shown in FIGS. 5 and 6, rotation of the worm 66 results in a change in the torque exerted by the torsion spring 30 on both arm 14 and on arm 12, through the worm gear 64 and worm 66. Because the axis of rotation of the torque exerted by the torsion spring 30 is perpendicular to the axis of rotation of the worm 66, the worm 66 is not subject to the torque of the spring, and will remain approximately at its set position until another adjustment force is applied to the worm. The torque on worm 66 by worm gear 64 and spring 30 is translated to arm 12. Again, although FIGS. 5 and 6 show the worm 66 as configured for a flathead screwdriver, other suitable rotation interfaces would function as understood by one skilled in the art and discussed above.

While the present invention has been illustrated by the description of the embodiments thereof, and while the embodiments have been described in considerable detail, it is not the intention of the applicant to restrict or in any way limit the scope of the appended claims to such detail. Additional advantages and modifications will readily appear to those skilled in the art. Therefore, the invention in its broader aspects is not limited to the specific details representative apparatus and method, and illustrative examples shown and described. Accordingly, departures may be made from such details without departure from the spirit or scope of applicant's general inventive concept.

What is claimed is:

1. A headset comprising:

an element to be held to the head of a wearer;

a headband coupled to the element and configured for engaging a head of a wearer to hold the element thereon, the headband including:

a plurality of headband arms coupled to pivot with respect to each other;

a torsion spring positioned between the arms, portions of the torsion spring coupled to the arms for acting on the arms with a torsion force;

an adjustment member coupled between the torsion spring and a headband arm, the adjustment member operable for adjusting the torsion force of the torsion spring to adjust the torsion force on the arms and having a locked and unlocked position, the adjustment member movable to adjust the torsion force when it is in the unlocked position and prevented from being moved in the locked position.

2. The headset of claim 1 wherein the adjustment member includes a bolt having a first end configured to engage a headband arm and a second end coupled with the torsion spring, the bolt movable for being selectively disengaged from the headband arm to be rotated to adjust the torsion force.

3. The headset of claim 2 wherein the adjustment member bolt includes a shaped head configured to seat in a shaped opening to prevent rotation of the bolt, the bolt being movable to unseat the head from the opening to allow rotation to adjust the torsion force.

4. The headset of claim 2 wherein the adjustment member bolt includes a slotted end configured for coupling with an end of the torsion spring, the bolt, when rotated, configured for rotating the end of the torsion spring to adjust the torsion force of the spring.

5. The headset of claim 2 wherein the bolt is biased to engage the headband arm and is selectively disengaged when the bolt is moved to overcome the bias.

6. The headset of claim 1 wherein the adjustment member is configured to provide discrete adjustment of the torsion force.

7. The headset of claim 1 wherein the element includes at least one speaker.

8. The headset of claim 1 wherein the element includes a pair of speakers, the speakers coupled to the end of respective headband arms.

9. The headset of claim 1 wherein the element includes at least one microphone.

10. The headset of claim 1 wherein the element includes electronics.

11. A headset comprising:

an element to be held to the head of a wearer;

a headband coupled to the element and configured for engaging a head of a wearer to hold the element thereon, the headband including:

a plurality of headband arms;

at least one pivoting section coupled between the headband arms;

the headband arms coupled to pivot with respect to the pivoting section;

a torsion spring positioned between at least one headband arm and the pivoting section, a portion of the torsion spring coupled to the arm for acting on the arm with a torsion force;

an adjustment member coupled between the torsion spring and headband arm, the adjustment member operable for adjusting the torsion force of the torsion spring to adjust the torsion force on the arm and having a locked and unlocked position, the adjustment member movable to adjust the torsion force when it is in the unlocked position and prevented from being moved in the locked position.

12. The headset of claim 11 wherein the adjustment member includes a bolt having a first end configured to engage a headband arm and a second end coupled with the torsion spring, the bolt movable for being selectively disengaged from the headband arm to be rotated to adjust the torsion force.

13. The headset of claim 12 wherein the adjustment member bolt includes a shaped head configured to seat in a shaped opening to prevent rotation of the bolt, the bolt being movable to unseat the head from the opening to allow rotation to adjust the torsion force.

14. The headset of claim 12 wherein the adjustment member bolt includes a slotted end configured for coupling with an end of the torsion spring, the bolt, when rotated, configured for rotating the end of the torsion spring to adjust the torsion force of the spring.

15. The headset of claim 12 wherein the bolt is biased to engage the headband arm and is selectively disengaged when the bolt is moved to overcome the bias.

16. The headset of claim 11 wherein the element includes at least one of a speaker, a microphone, or electronics.

17. The headset of claim 11 wherein the adjustment member is configured to provide discrete adjustment of the torsion force.

18. A headset comprising:

an element to be held to the head of a wearer;

a headband coupled to the element and configured for engaging a head of a wearer to hold the element thereon, the headband including:

a plurality of headband arms coupled to pivot;

a torsion spring positioned with respect to at least one arm, a portion of the torsion spring coupled to the arm for acting on the arm with a torsion force;

an adjustment member coupled between the torsion spring and a headband arm, the adjustment member operable for adjusting the torsion force of the torsion spring to adjust the torsion force on the arm;

the adjustment member including a rotatable worm and a worm gear that is coupled with the worm for rotating when the worm rotates, the worm gear engaging an end of the torsion spring for rotating the end of the spring and winding the spring to adjust the torsion force of the spring.

19. The headset of claim 18 wherein the adjustment member includes a slotted shaft, the slotted shaft coupled at one end with the worm gear and including a slot for engaging an end of the torsion spring to rotate an end of the torsion spring when the worm gear is rotated.

20. The headset of claim 18 further comprising:

at least one pivoting section coupled between the headband arms wherein the headband arms are coupled to pivot with respect to the pivoting section;

the torsion spring positioned between at least one headband arm and the pivoting section, a portion of the torsion spring coupled to the arm for acting on the arm with a torsion force.

21. The headset of claim 18 wherein the plurality of headband arms are coupled to pivot with respect to each other, the torsion spring positioned between the arms and portions of the torsion spring coupled to the arms for acting on the arms with a torsion force.

* * * * *